US007069706B2

(12) United States Patent
Hoogland

(10) Patent No.: US 7,069,706 B2
(45) Date of Patent: Jul. 4, 2006

(54) DEVICE FOR PACKAGING COCOA BEANS AND SUCH NATURAL PRODUCTS

(75) Inventor: Hendrik Antonius Hoogland, Krommenie (NL)

(73) Assignee: =InnoSpecial Products B.V., Capelle A/D Ijss (NL)

( * ) Notice: Subject to any disclaimer, the term of this patent is extended or adjusted under 35 U.S.C. 154(b) by 54 days.

(21) Appl. No.: 10/438,695

(22) Filed: May 15, 2003

(65) Prior Publication Data

US 2004/0016215 A1 Jan. 29, 2004

Related U.S. Application Data

(63) Continuation of application No. PCT/NL01/00823, filed on Nov. 14, 2001.

(30) Foreign Application Priority Data

Nov. 15, 2000 (NL) ..... 1016609

(51) Int. Cl.
*B65B 67/12* (2006.01)
*B65D 88/00* (2006.01)
*B65D 30/10* (2006.01)

(52) U.S. Cl. ..... 53/171; 53/247; 206/600; 220/1.6; 220/9.2; 220/9.4

(58) Field of Classification Search ..... 220/1.5, 220/1.6, 9.1–9.4; 206/600
See application file for complete search history.

(56) References Cited

U.S. PATENT DOCUMENTS

| | | | | |
|---|---|---|---|---|
| 1,263,294 | A * | 4/1918 | Taylor | 220/9.3 |
| 2,054,044 | A | 9/1936 | Rendleman | |
| 2,561,143 | A | 7/1951 | Schmitz | |
| 4,314,686 | A * | 2/1982 | Marz | 206/600 |
| 4,529,088 | A | 7/1985 | Quong | |
| 4,538,663 | A * | 9/1985 | Looker | 220/1.5 |
| 4,817,824 | A * | 4/1989 | LaFleur et al. | 220/1.6 |
| 5,531,352 | A | 7/1996 | Kraft et al. | |
| 5,722,552 | A * | 3/1998 | Olson | 220/9.2 |
| 5,762,229 | A * | 6/1998 | Tatsu et al. | 220/495.03 |
| 5,908,649 | A | 6/1999 | Floyd et al. | |
| 6,010,021 | A * | 1/2000 | Zuidam et al. | 220/1.5 |
| 6,685,420 | B1 * | 2/2004 | Moser et al. | 220/1.5 |

FOREIGN PATENT DOCUMENTS

| | | | |
|---|---|---|---|
| EP | 0 373 506 | A1 | 6/1990 |
| GB | 2150110 | A * | 6/1985 |

* cited by examiner

*Primary Examiner*—Stephen F. Gerrity
(74) *Attorney, Agent, or Firm*—Jeffrey D. Myers; Rod. D. Baker; Peacock Myers, P.C.

(57) ABSTRACT

A method for packaging coca beans and like bean-shaped natural products, wherein the cocoa beans are packaged in ventilating, at least partially relatively form-retaining and stackable packaging devices. Packaging devices for cocoa beans or like bean-shaped, natural products, which packaging device comprises a frame and a sack-shaped element suspendible therein, wherein a filling opening is provided for bringing the products into at least the sack-shaped element and wherein the frames with filled sacks are stackable.

18 Claims, 8 Drawing Sheets

DEVICE FOR PACKAGING COCOA BEANS AND SUCH NATURAL PRODUCTS

CROSS-REFERENCE TO RELATED APPLICATIONS

This application is a continuation of International Patent Application Serial No. PCT/NL01/00823, entitled "Method and device for packaging cocoa beans and such natural products" to Hoogland, Hendrik, Antonius, having an international filing date of Nov. 14, 2001, (now abandoned) and claiming priority to Netherlands Patent Application Serial No. 1016609, having a filing date of Nov. 15, 2000, and the specifications thereof are incorporated herein by reference.

BACKGROUND OF THE INVENTION

1. Field of the Invention

The invention relates to a method for packaging cocoa beans and like bean-shaped natural products.

2. Description of Related Art

Usually, cocoa beans are picked and transported in bulk to storage devices such as, for instance, silos. Therein, the cocoa beans are stacked high in that they are poured in bulk prior to further processing. Such a method has as a drawback that ventilation of the cocoa beans is virtually impossible, notably of cocoa beans lower in the stack. As a result, mold formation and heating occur which has to be prevented by, for instance, regularly turning over the poured beans. A further drawback of such a method is that there is a great risk of vermin among the beans. Further, this known method has as a drawback that different loads of cocoa beans will become mixed, thus making it very difficult, if not impossible, to take away beans from a specific load for, for instance, further processing. The fact is that, generally, by pouring the beans in bulk the last poured beans will be taken away first.

Further, it has already been proposed to package cocoa beans in individual sacks, in particular burlap sacks, in which the beans can be transported from, for instance, plantations to storage positions, where the cocoa beans are stacked in the sacks in sheds. Thus, the advantage is achieved that individual sacks of cocoa beans can be placed and taken away, for instance to be processed further, without mixing of different loads of cocoa beans occurring. However, this method has as a drawback that here, also, bad ventilation of the cocoa beans occurs, so that mold formation and heating can still occur. Moreover, the relatively small sacks will have to be repositioned regularly when sacks are to be taken away for further processing. This is particularly inconvenient and time consuming when sacks are stacked relatively high. A further drawback is that the full weight of the beans is carried by sacks lower in the stack. This means that the sacks cannot be stacked particularly high, because, otherwise, the lower cocoa beans will experience undesirably high pressures and can become crushed.

BRIEF SUMMARY OF THE INVENTION

The invention contemplates a method of the type described in the preamble, wherein the drawbacks mentioned are avoided while maintaining its advantages. To that end, a method according to the present invention is characterized by a packaging device for cocoa beans or like bean-shaped natural products, which packaging device comprises a frame and a sack-shaped element suspendible therein, which sack-shaped element is ventilating, wherein a filling opening is provided for at least bringing said products into the sack-shaped element and wherein the frames with the filled sacks are stackable, wherein the sack-shaped element is removably suspended within said frame and is substantially manufactured from textile woven plastic and/or ventilating film, wherein the frame is substantially foldable and/or detachable.

Packaging the cocoa beans or such products in ventilating, at least partly relatively form-retaining and stackable packaging devices offers the advantage that the cocoa beans can be transported in the respective package and can be stored by stacking the packaging devices, while occurring forces are transmitted by the packaging devices. This means that the cocoa beans themselves are not loaded by cocoa beans in other packaging devices stored on them or next to them. Moreover, such a method has the advantage that ventilation of the cocoa beans remains possible in a simple manner, per individual packaging device as well as with stacked packaging devices. Then, the relatively form-retaining packaging devices offer the advantage that they can be stacked and destacked relatively simply, and, more generally, can be handled more easily, for instance during loading and unloading of transport means such as ships and trucks, in storing spaces such as silos and in further processing apparatuses.

In an advantageous further embodiment of a method according to the invention packaging devices are used, characterized by a packaging device as previously described wherein the frame comprises a bottom frame and two frame wall parts, wherein the frame wall parts extend at two opposite ends of the bottom frame and are connected therewith via hinging means, such that the frame wall parts can be brought into in a first position wherein they extend approximately parallel to the bottom frame and into a second position wherein they extend approximately at right angles to the bottom frame.

Using at least one sack-shaped element suspended in a frame, at least in one packaging device according to the invention, offers the advantage that in a relatively simple manner a bulk package for cocoa beans is obtained which, nevertheless, can be handled individually. Here, the frame presents a relatively rigid part of the packaging device, with which the packaging device can be held, lifted and stacked, the sack-shaped element offering the necessary space for the pouring of the cocoa beans. Thus, the frame offers the support for the sack-shaped element. Preferably, the sack-shaped element can be emptied by tilting the frame with the sack-shaped element.

Then, it is preferred that packaging devices are used which, when stacked, leave a space between the various individual sack-shaped elements, such that therebetween ventilation air can be circulated which can flow around and through the packaging devices, in particular the sack-shaped elements and the cocoa beans received therein, while, if desired, it can be forced through between the cocoa beans. Preferably, the packaging devices are dimensioned such that they can be fittingly stacked in standard containers so as to virtually completely fill them. Thus, the processing of the cocoa beans is further simplified. Further, it is preferred that the packaging devices are foldable or detachable, such that, in empty condition, they take up a considerable smaller volume than in set-up, operative condition. This means that storage and transport of the empty packaging devices is possible in a simple manner, while little space is taken up, while the packaging devices in set-up condition offer a suitably large volume.

The invention further relates to a method for handling cocoa beans or like products, characterized by a packaging device as previously described wherein, in operative condition, the sack-shaped element at least comprises an upstanding wall closed in itself and a bottom connected thereto, wherein the parts of the wall opposite each other are connected to each other by at least one dividing wall, wherein the or each dividing wall has a height smaller than the distance between the bottom and the free longitudinal edge of the wall, the arrangement being such that adjacent at least one dividing wall an opening is formed between the bottom and the edge of the respective dividing wall proximal to the bottom.

With such a method, in a simple manner, packaging devices can be transported to a site of harvest, be filled there with cocoa beans or like products and be discharged in filled condition, for instance to storage locations or apparatuses for further processing. The frames used are preferably foldable or detachable, so that transport of the empty packaging devices takes up very little space.

The invention further relates to a packaging device for cocoa beans or like products, characterized by a frame forming a packaging device as previously described.

Such a packaging device offers a relatively large volume for storing cocoa beans, wherein the frames are stackable, such that, when stacked, the cocoa beans are not loaded, so that a relatively high stack can be formed without undesired load on the cocoa beans. Moreover, with a packaging device according to the present invention, a frame offers the advantage that it enables a simpler handling of the packaging device, for instance during transport and storage or during emptying of the package, while the sack-shaped element offers a suitable space for receiving the cocoa beans. Here, it is preferred that the frame is substantially foldable and/or detachable so it can be stored and transported with relatively small volume prior to the beans being received therein or after they have been taken out.

In an advantageous embodiment, a packaging device according to the invention is further characterized by a method for packaging cocoa beans and like bean-shaped natural products, wherein the cocoa beans are packaged in ventilating, at least partly relative form-retaining and stackable packaging devices according to a packaging device previously described.

In such an embodiment, when the frame is folded, the frame wall parts can be received against or in the bottom frame, while, at a second position, they extend approximately at right angles to the bottom frame and offer space for suspending the sack-shaped element.

In a further advantageous embodiment a packaging device according to the invention is further characterized by a method as previously described wherein frames are used of a modular size with a length of approximately 0.6 meter, a width of approximately 0.5 meter and a height of approximately 0.6 meter.

With such an embodiment, when the packaging device is set-up, it is provided that the sack-shaped element always retains the desired shape and is held in the desired position relative to the frame, also when this frame is, for instance, tilted for at least partly emptying the sack-shaped element. Detachably connecting the sack-shaped element with the frame offers the advantage that this sack-shaped element can be stored and transported separately and can be cleaned prior to reuse.

The invention further relates to an assembly of a container and a series of packaging devices, characterized by a method for handling cocoa beans or like bean-shaped, natural products, wherein a series of frames is transported to a position near a harvesting location for cocoa bean, as well as a series of sack-shaped elements, wherein at said position the frames are positioned, the sack shaped elements are suspended in the frames such that a filling opening is created and the sack-shaped elements, via the filling opening, are filled with cocoa beans, whereupon the frames with the filled sack-shaped elements are discharged and wherein the sack-shaped elements are emptied and thereupon folded together, after which the sack-shaped elements are returned to said position or such location for reuse and wherein the packaging devices are emptied by tilting them.

Such an assembly offers the advantage that in a particularly effective manner use is made of the inner space of a container, which container offers the possibility that a relatively large number of packaging devices can be taken up and moved simultaneously. The use of the packaging devices within the container then offers the advantage that individual handling of the packaging devices still remains possible in a simple manner, while ventilation is guaranteed.

The invention further relates to a frame and a sack-shaped element for use with a method or packaging device according to the present invention.

The invention further relates to a logistic system for transporting cocoa beans from plantations, at least from positions where cocoa beans are harvested and/or collected, characterized by a storage space and processing apparatus for cocoa beans and like bean-shaped products wherein packaging devices as previously described are used for storing the cocoa beans, wherein lifting means are provided for stacking and destacking the packaging devices, wherein, further, means are provided for tilting the packaging devices over at least more than 90° and preferably approximately 180°, for emptying them into the processing apparatus and wherein said tilting means tile the packaging devices over approximately 180°.

With such a logistic system, the advantage is achieved that simply, and for the greater part automatically, it can be determined at which moment a suitable number of packaging devices, i.e. for instance frames and sack-shaped elements as well as containers, have to be present at a particular position, for packaging a sufficiently large amount of cocoa beans, for repacking in packaging devices in the respective containers and, subsequently, for transporting the containers to storage locations such as silos, for storage and further processing.

The invention further relates to a storage space and processing apparatus for cocoa beans or like products, characterized by a storage space and processing apparatus for cocoa beans and like bean-shaped products wherein packaging devices as previously described are used for storing the cocoa beans, wherein lifting means are provided for stacking and destacking the packaging devices, wherein, further, means are provided for tilting the packaging devices over at least more than 90° and preferably approximately 180°, for emptying them into the processing apparatus and wherein said tilting means tile the packaging devices over approximately 180° and wherein racks with rolling means are provided in which the packaging devices can be arranged such that the packaging devices can be moved over the rolling means within the racks so that, each time, a suitable packaging device can be placed or taken out with the lifting means.

A storage space and processing apparatus according to the invention offers the advantage that in a simple and economical manner, the cocoa beans can be stacked in the storage space in individual packages in which the cocoa beans are poured in bulk. Here, the lifting means offer the advantage that the packaging devices can be stacked and destacked in a simple manner, while the means for tilting the packaging device offer the advantage that the beans poured in bulk can be simply poured out of the packaging. The lifting means and the means for tilting can simply be combined, for instance in the form of a fork lifting truck arranged to that end. The packaging devices can then be placed in the storage space in racks, for instance on rolling means, such that the packaging devices can be easily moved in the storage space so that, each time, a suitable packaging device becomes available to be handled by the lifting means. Thus, in a even simpler manner, each time a desired individual packaging device can be taken up and moved, for instance for processing the cocoa beans received therein. Ventilation between and through the packaging devices remains always possible.

BRIEF DESCRIPTION OF THE SEVERAL VIEWS OF THE DRAWINGS

Further advantageous embodiments of a method and packaging device are further specified in the accompanying drawings. In elucidation of the invention, exemplary embodiments of a method, packaging device, frame and sack-shaped element, a logistic system and storage space with processing apparatus according o the invention will be further elucidated, both individually and in combination, with reference to the drawing. In the drawing.

DETAILED DESCRIPTION OF THE INVENTION

Figure 1:
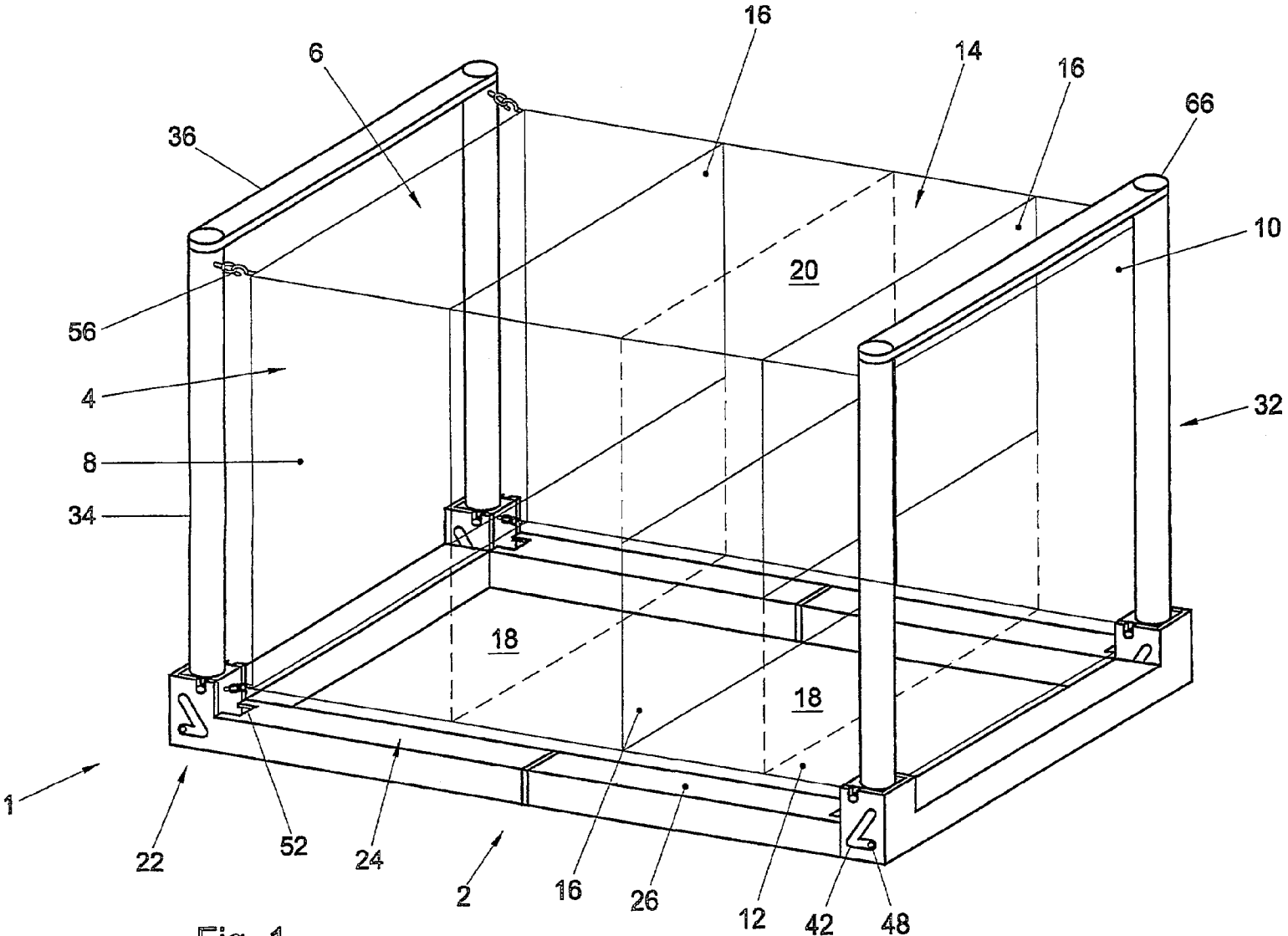
FIG. 1 schematically shows, in perspective view, a first embodiment of a storage device according to the invention.

In this description, identical or corresponding parts have identical or corresponding reference numerals. In this drawing, only exemplary embodiments are shown, which should not be construed as being limitative in any way.

In FIG. 1, in perspective view, a packaging device 1 according to the invention is shown, which is substantially built up from a frame 2 and a sack-shaped element 4, which will be further indicated as a sack 4. In FIG. 1, the upper side 6 of the sack 4, shown from above, is shown in open condition but it can also be closable. Further, the sack 4 comprises two longitudinal walls 8, two end walls 10 and a bottom 12, mutually connected for forming a receiving space 14 in which cocoa beans (not shown) can be poured via the open upper side 6. Between the longitudinal walls 8, dividing walls 16 are disposed, which have a height smaller than the height of the longitudinal walls 8. The dividing walls 16 are provided so as to be staggeringly connected to the upper side 6 and to the bottom 12, so that between a dividing wall 16 connected adjacent the upper side 6 and the bottom 12 a passage opening 18 is provided, while between the dividing wall 16 connected to the bottom 12 and the upper side 6, a passage opening 20 is provided. This means that in a simple manner, a uniform distribution of cocoa beans in the receiving space 14 can be obtained, so that this can be completely filled. The dividing walls 16 enable the longitudinal walls 8 to be held in the desired position, i.e. substantially vertically and parallel to each other. It will be clear that also other numbers of dividing walls 16 can be provided which can extend also over other heights, optionally the entire height, while, then, a more accurate filling needs to be provided.

The sack 4 is at least largely manufactured from an air permeable material, for instance a woven, gauze, light-permeable film, braiding or the like, with openings such that the cocoa beans cannot fall through. Also, the sack 4 can be completely or partly of semi-permeable material. The purpose of this is that the sack 4 is air-permeable and, therefore, can ventilate. This means that rotting or mold formation in the cocoa beans in the receiving space 14 can be relatively easily prevented. Also, in frame parts, perforated panels, gauze parts or the like can be included. In this context a sack-shaped element 4 is also meant to include foldable, crate-like elements, integrated or not integrated in the frame 2.

In a manner to be described further, the frame 2 is foldable between a first position wherein this is folded and takes up a minimal space, and a second position wherein the sack 4 can be suspended within the frame 2 as shown in FIG. 1. In the first, folded position, the sack 4 can be removed or folded with the frame 2. Optionally, the frame can also be designed to be fully or partly detachable for obtaining a minimal volume. Moreover, using a frame enhances the stackability, which is of interest notably when packaging rolling products such as cocoa beans.

Figure 2:
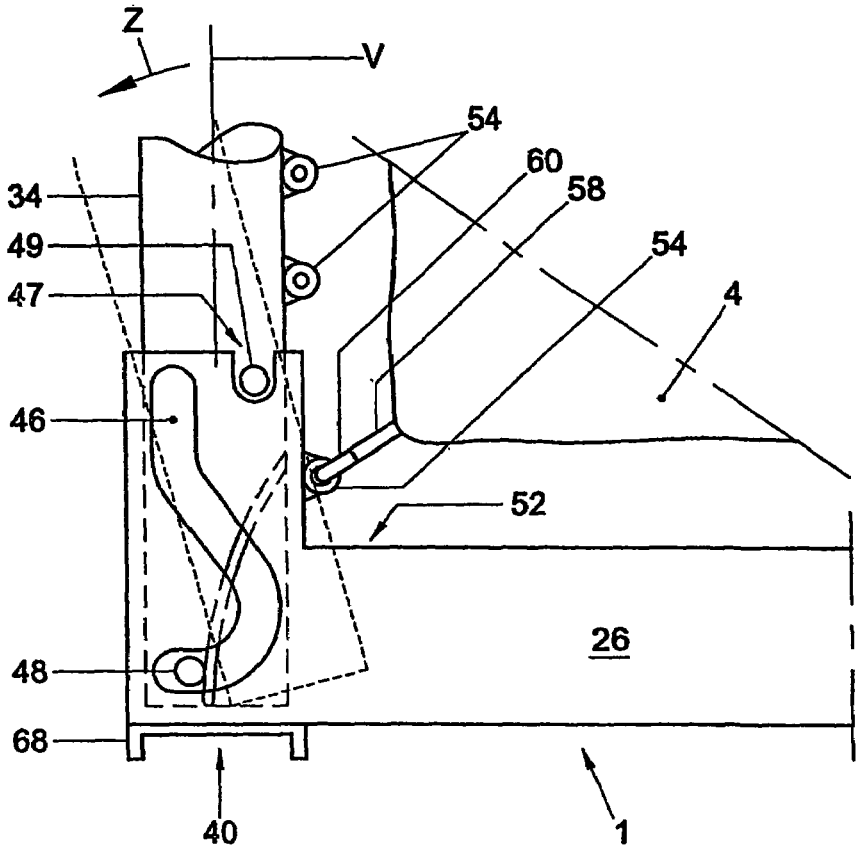
FIG. 2 schematically shows, in side view, a lower corner of a device according to FIG. 1, in set-up condition.
Figure 3:
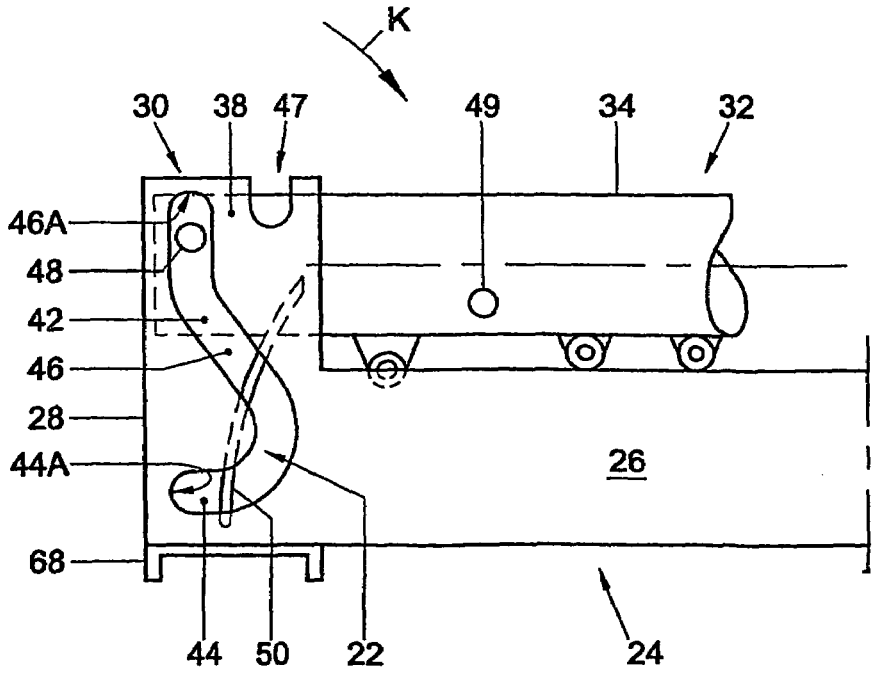
FIG. 3 shows the corner of FIG. 2, in collapsed condition.

In FIGS. 2 and 3, a part of the packaging device 1 according to the invention is shown, in particular a left hand lower corner, in elucidation of the rotating and blocking means 22. Here, FIG. 2 shows the set-up condition, FIG. 3 the folded condition.

The frame 2 comprises a frame-shaped bottom frame 24, substantially built up from tubular profiles 26, rectangular in the embodiment shown. At the four corners a tubular element 28 is provided which, at the upper side, defines a recess 30. At two sides of the frame 2 located opposite each other a frame wall part 32 is provided, each substantially built up from two legs 34 extending parallel to each other, mutually connected adjacent the upper ends by a cross beam 36. The lower ends 38 of the legs 34 are put through the recesses 30 mentioned into the tubular elements 28 and, in the set-up condition as shown in FIG. 2, rest on the bottom 40 of the respective tubular element 28. On at least one and preferably both sides of the tubular element 28 a somewhat L-shaped or hockey stick-shaped guideway 42 is provided, an approximately horizontally extending part end 44 of which extends approximately horizontally, adjacent the lower side of the bottom frame 24, while an inclining part 46 of the guideway 42 reaches adjacent the recess 30 mentioned. The guideways 42 provided adjacent the two ends of the bottom frame 24 are positioned such that the connections between the end parts 44 and the inclining parts 46 are proximal to each other. Each time, the closed end 44*a* of the end part 44 lies approximately straight under the closed end 46*a* of the inclining part 46. Each time, through the lower end 38 mentioned of the leg 34, a guiding pin 48 extends into the or each adjacent guideway 42, such that upon movement of the leg 34, the guiding pin 48 is guided through the guideway 42 and is limited in its freedom of movement. In the upper edge of the tubular profile, a recess 47 is disposed open towards the top, into which, when the frame is set up, a blocking pin 49 falls, attached in the leg 34. Thus, a horizontal movement of the leg 34 is effectively prevented.

Within the tubular element 28, against a wall thereof, a spring element, in particular a leaf spring 50 is attached, which reaches downwards at an inclination adjacent the bottom 40 as is clearly shown in FIGS. 2 and 3. There, the or each spring element 50 crosses at least the inclining part 46 of the guideway 42 and/or the end part 44 thereof, at least in non-loaded condition. As is clear from FIG. 2, with a packaging device 1 in set-up condition, the guiding pin 48 is confined between the closed end 44*a* mentioned and the spring 50, so that the leg 34 is confined in the vertical position. With the folded condition shown in FIG. 3, the guiding pin 48 at least practically abuts the closed end 46*a* of the inclining part 46 of the guideway 42, while the leg 34 extends approximately parallel to the plane of the bottom frame 24 and can be in contact with it.

The frame wall part 32 can be brought from the position shown in FIG. 2 to the position shown in FIG. 3 by, firstly, rotating the frame wall part mentioned in the direction remote to the opposite frame wall part 32 as indicated in FIG. 2 by the arrow Z and schematically represented in interrupted lines, so that the guiding pin 48 is moved through the end part 44, while pushing away the spring 50. Subsequently, the guiding ping 48 can be moved in the inclining part 46, past the spring 50, by pulling away the respective frame wall part 32 in upward direction remote from the bottom 40. Thus, the blocking pen 47 is pulled out of the recess 49. When the guiding pin 48 strikes the closed end 46*a*, this can be rotated in the direction of the bottom frame 24, approximately about the guiding pin 48 mentioned, in the direction of the arrow K, to the position shown in FIG. 3. When setting up the frame from the position shown in FIG. 3, evidently the reverse order is kept. As is clear from FIG. 5, in the tubular element 28 at the side proximal to the sack 4, the wall is taken away and in the tubular profile 26 a substantially U-shaped recess 52 is provided, in which the leg 34 can move during rotating. In set-up condition, the leg 34 rests against the opposite wall of the tubular element 28 and the blocking pin 47. The corner of the lower end 38 of the leg 34, located adjacent the guiding pin 48 can be rounded, as is represented in interrupted lines, so that it can rotate along the wall of the tubular wall 28 mentioned about the guiding pin 48 mentioned. Also, to that end, the wall mentioned can be somewhat lowered.

The rotating and blocking means 22, 47, 48, 49 mentioned offer the advantage that the frame in the set-up condition, as shown in FIGS. 1 and 2, can simply be picked up and, for instance, turned upside down, without the frame wall parts 32 coming loose or rotating relative to the bottom frame 24. In particular also because, as will be elucidated later, when the sack 4 is filled, the upper ends of the frame wall parts 32 will be somewhat pulled towards each other, thus obtaining an even better confinement.

To each leg or, preferably, tubular element 28, adjacent the frame part 26 an eye 54 is fastened, while a comparable eye 56 is provided near each upper end of a leg 34. At its eight corners, the sack 4 is provided with a lip 58 having a hook element 60 at the free end which is hooked in the respective eye 54. To that end, preferably, the lips 58 are designed to be somewhat elastic. The dimensions of the sack 4, the lips 58 and the hooking elements 60 are chosen such that the sack 4 is somewhat stretched between the frame wall parts 32, at least the eyes 54, 64. It will be clear that, naturally, more lips 58 and hooking elements 60 can be provided, which can be fastened to further eyes 54, 64, for instance for further stretching the sack 4. Naturally, the eyes 54, 56 can be provided above or next to the recesses 52, but can optionally also be attached only to the legs 34 and/or the cross beams 36. It will be clear that eyes and hooks can be provided at any desired suitable position.

Figure 5:
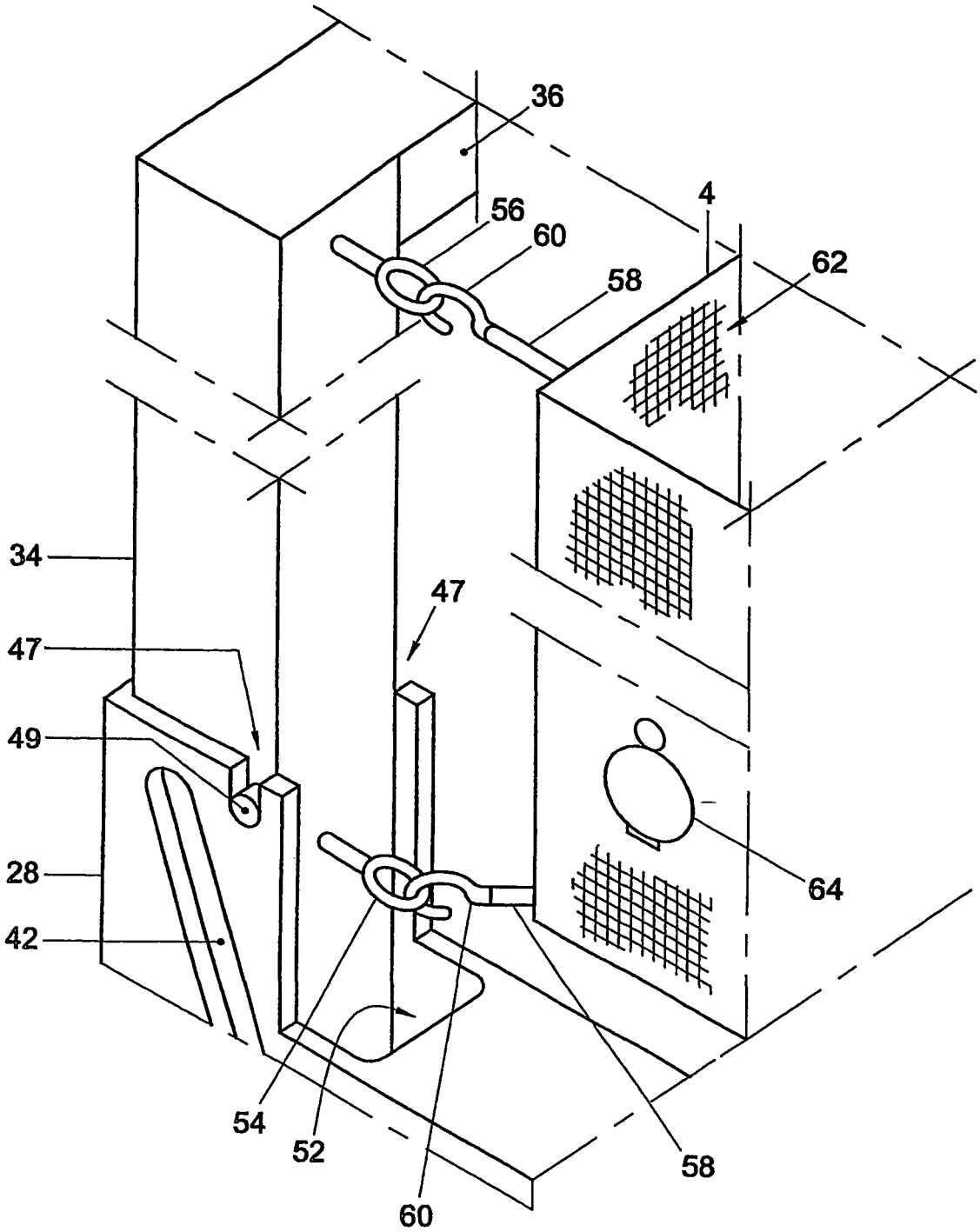
FIG. 5 shows in perspective front view a part of a device according to FIG. 1, in enlargement.

As is clearly shown in FIG. 5, the sack 4 is manufactured from a ventilating woven, schematically indicated by crosswise hatchings on only a part of the walls 6, 8 of the sack 4. Naturally, the sack 4 can be manufactured entirely or partly from such a ventilating material.

In its wall, in FIG. 5 in its longitudinal wall 8, the sack 4 is provided with a preferably closable opening 64 through which a sample can be taken of the beans present in the receiving space 14. Optionally, to that end, a trunk-shaped hose can connect to the opening 64, so that when the opening 64 is opened, direct release of beans is prevented.

Figure 4:
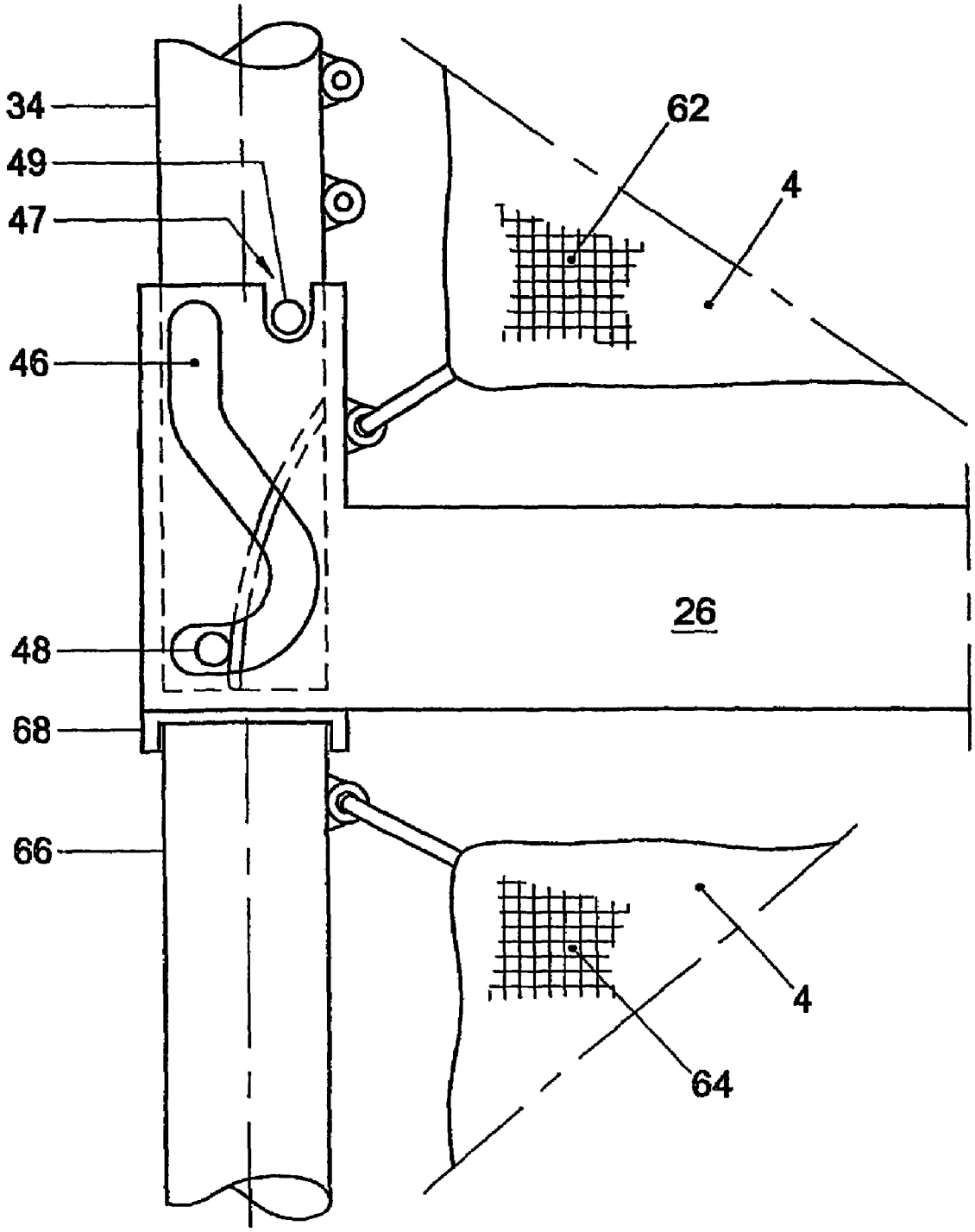
FIG. 4 shows a detail with a corner of FIGS. 2 and 3 of two stacked devices according to FIG. 1.

As is clear from FIG. 4, the packaging devices 1 are stackable in a simple manner. To that end, first stacking means 66 are provided adjacent the upper ends of the frame wall parts 32, for instance disc-shaped elongations of the legs 34, while the bottom frame 24 under the legs 34 is provided with second stacking means 68, for instance welded-on rings in which the first stacking means 66 mentioned can be fittingly received. As a result, a particularly stable stacking is obtained. It will be clear that the first and second stacking means 66, 68 can be designed in any other suitable manner.

Figure 6:
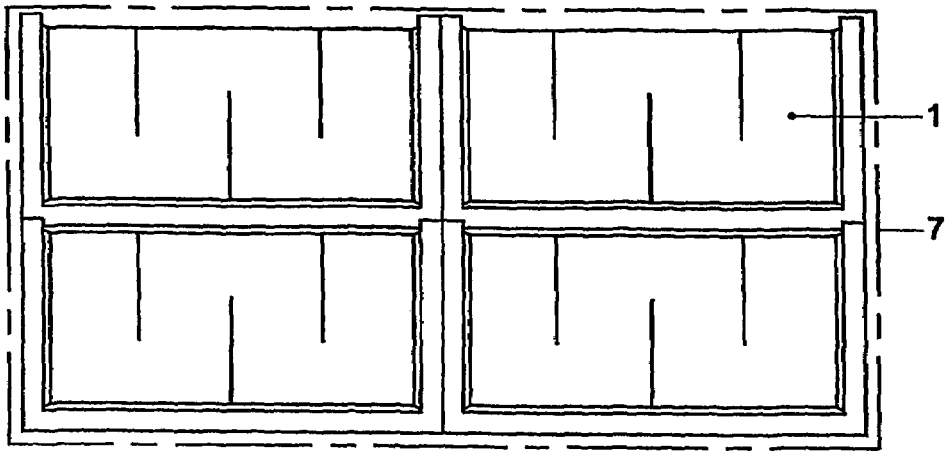
FIG. 6 schematically shows, in side view, four devices according to the invention, stacked in a standard container.

FIG. 6 shows a stacking of packaging devices in a container 70, in particular a standard container such as a shipping container. As is clear from FIG. 6, the outer dimensions of the packaging devices 1, which are substantially defined by the dimensions of the frames 2, are chosen such that the container 70 can be fittingly filled with a discrete number of packaging devices. In the embodiment shown in FIG. 6, at least viewed in side view, four packaging devices 1 fittingly fit into the container 70, while, for instance, two rows of four packaging devices can be disposed next to each other. For instance, packaging devices according to the invention have a bottom size of 1 m×1.2 m, and a height of 1.2 m, which dimensions are only given by way of example. Naturally, with a suitable choice of the dimensions, other numbers of packaging devices can be fittingly received in a container 70 in a comparable manner.

Figure 7:
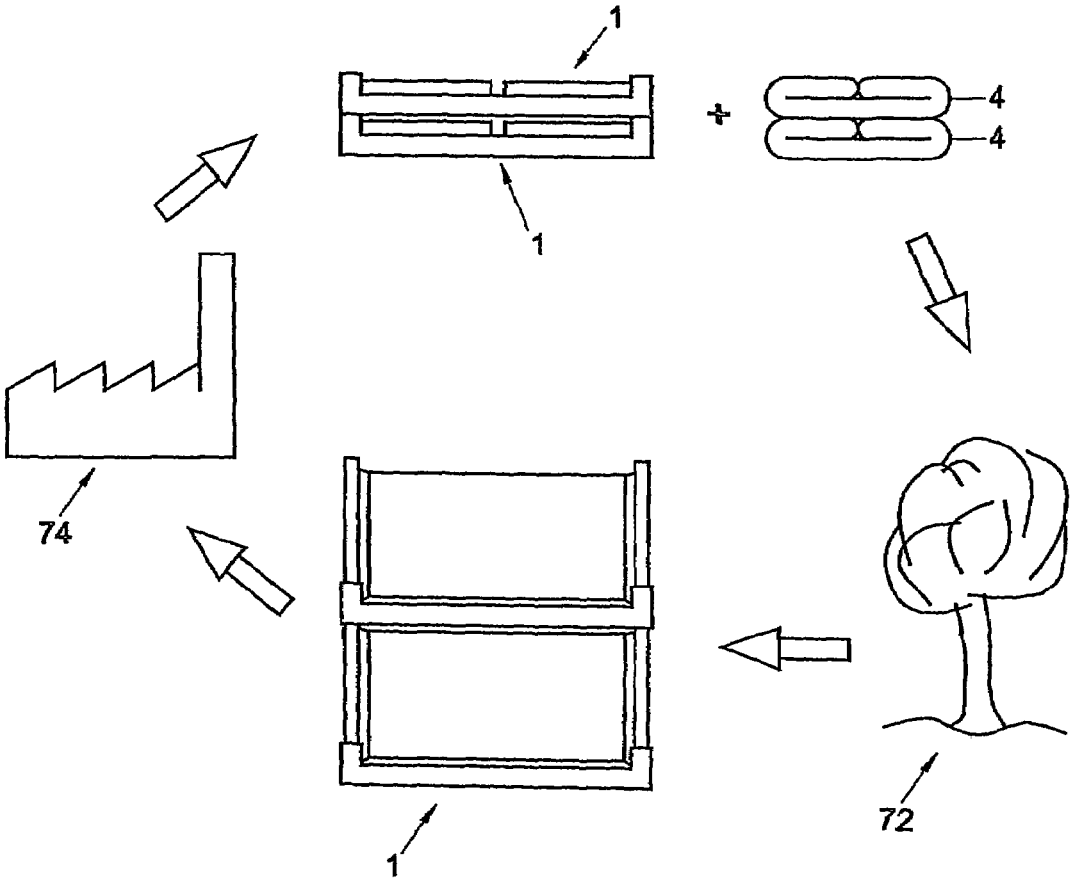
FIG. 7 schematically shows a method according to the invention.

In FIG. 7 it is schematically represented how packaging devices according to the invention can be used. A number of frames 2, in folded condition as represented in part in FIG. 3, are carried to a plantation 72 preferably in stacked condition, together with a corresponding number of sacks 4, represented in folded condition. As the packaging devices take up a relatively small volume, a large number of such packaging devices can be transported in a simple manner. At the plantation mentioned, at least at a suitable filling location, the packaging devices 1 are set up by folding out the frames 2 and suspending the sacks 4. Subsequently, the sacks 4 are filled with cocoa beans from the plantation 72, whereupon the packaging devices, stacked and preferably packaged in containers 70, are transported to a storage space and/or processing apparatus 74, where the packaging devices are taken out of the containers 70 integrally, for instance with a forklift truck, and are positioned in a storage space 74. To that end, the packaging devices 1 can be restacked, but can also be placed, for instance, in racks or on rollers or the like, so that moving is possible in a simple manner. As the sacks 4 are air-permeable and do entirely abut each other, as a consequence of the frames 2, during transport and storage ventilation of the cocoa beans in the sacks 4 can be ensured, so that mold formation, rotting and the like can simply be prevented. As the packaging devices can simply be taken up and moved in their entirety, each time a suitable choice from the beans present can be made for further processing. If a particular packaging device, at least the cocoa beans present therein are ready to be processed, the packaging device is simply lifted up, for instance with a suitable forklift truck or the like, whereupon the packaging device 1 can be driven to a pouring location. There, the packaging device 1 is tilted, preferably to a position wherein the open upper side 6 is substantially directed downwards. As a result of the rotating and blocking means 22, it is then simply prevented that the frame wall parts 32 rotate, so that the sack 4 can be emptied in a simple manner. Thereafter, the sack 4 can be taken from the frame 2, by detaching the hooking elements 60, after which the sack can be discharged, for instance to be cleaned. To that end, the sack 4 is preferably of washable design, so that cleaning is possible in a simple manner. The frame 2 can be folded, in an earlier described manner, and be stored for reuse.

It is preferred that use is made of a calculating unit with which, each time, the amount of packaging devices 1, at least frames 2 and sacks 4 can be calculated which have to be transported to a particular plantation 72, at least assembly point for packaging the cocoa beans or such products available there, while, moreover, it can be calculated how many containers 70 are necessary for storage and transport thereof. Thus, a particularly simple and economically logistic system is obtained.

Figure 8:
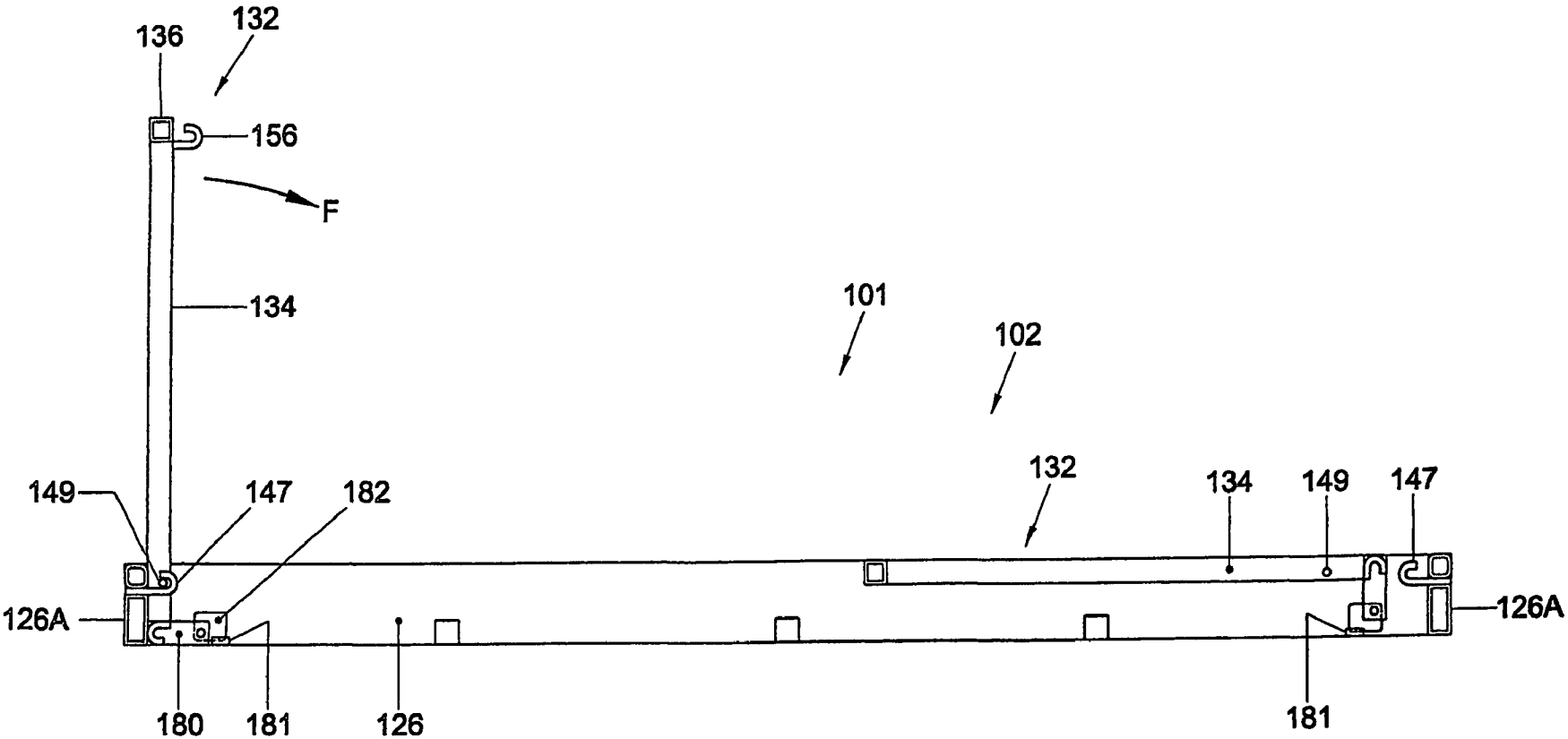
FIG. 8 schematically shows, in side view, a frame for a device according to the invention, in an alternative embodiment.
Figure 9:
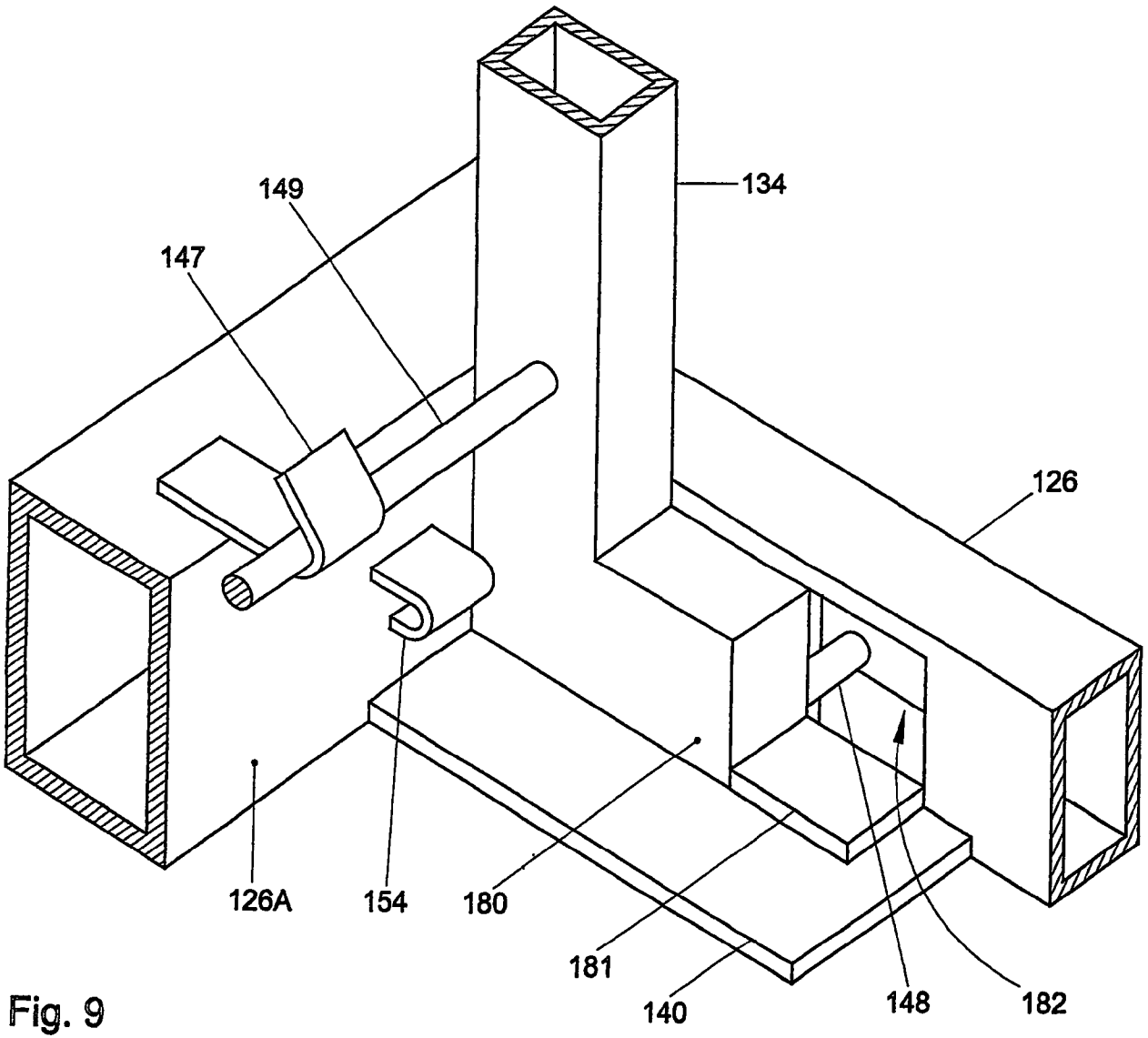
FIG. 9 shows, in enlargement, a corner of a frame according to FIG. 8, in set-up condition.

FIG. 8 schematically shows, in side view, an alternative embodiment of a frame 102 for a packaging device 101 according to the invention. Corresponding parts have corresponding reference numerals, increased by 100. In this schematic view, at the left hand side, a frame wall part 132 in set-up condition is shown, at the right hand side in collapsed condition. In FIG. 9, in perspective view, a lower corner of a frame according to FIG. 8 is shown, viewed from the inside. The frame 102 comprises two parallel extending longitudinal girders 126 and two cross beams 126A mutually connecting the longitudinal girders at their end faces. The girders 126 are manufactured from tubular profiles. In the longitudinal girders 126, adjacent the ends face on both sides, rectangular recesses 182 are provided, adjacent the lower sides. The frame wall parts 132 comprise two legs 134 extending parallel to each other, connected at the upper end by a transverse connection 136, while, adjacent the lower ends, the legs are provided with a leg part 180 extending, in set-up condition of the frame wall part 132, approximately horizontally and parallel to the longitudinal girders 126. Adjacent the free end of the leg part 180, a blocking pen 148 is provided which reaches into the rectangular recess 182 and has relatively much play therein. Near a lower end, the two legs 134 are mutually connected by a cross bar 149, for instance with a circular cross section. This cross bar 149 extends parallel to the crossbeams 126A, adjacent an upper side thereof. On the upper side of the crossbeams 126A, a number of hooking elements 147 are fastened, for instance by welding, the open side turned upwards and outward. With a set-up frame wall part 132, shown in FIG. 8 at the left hand side, FIG. 9 and FIG. 10A, the cross bar 149 is received within the hooking elements 147. A sack-shaped element 104 can, again, be attached to the hooking elements 154, 156. When loaded by the sack-shaped element, the frame wall part 132 is loaded in the direction F, so that this, in principle, will have the tendency to rotate about the cross bar 149, within the hooking element 147, wherein horizontal leg part 180 is pushed against a horizontal plate part 140 welded between the frame parts 126, 126A, while the blocking pin 148 is pushed into a lower corner of the recess 182 proximal to the cross beams 126A. Then, the lower end of the legs 134 is pushed against the cross beam 126A. In this condition, the frame wall part 132 is securely confined and the packaging device 101 can be simply manipulated and, for instance, be held upside down to be emptied. Moreover, on the plate part 140, a locking projection 181 is provided, against which the free end of the leg part 180 abuts. As a result, the leg 134 cannot rotate without it being at least somewhat lifted up, whereupon the hook 147 will at least somewhat deform as will be discussed further.

In FIG. 8 at the right hand side, the frame wall part 132 is brought in folded-down condition. With reference to FIGS. 10A–D, this will be explained further.

Figure 10B:
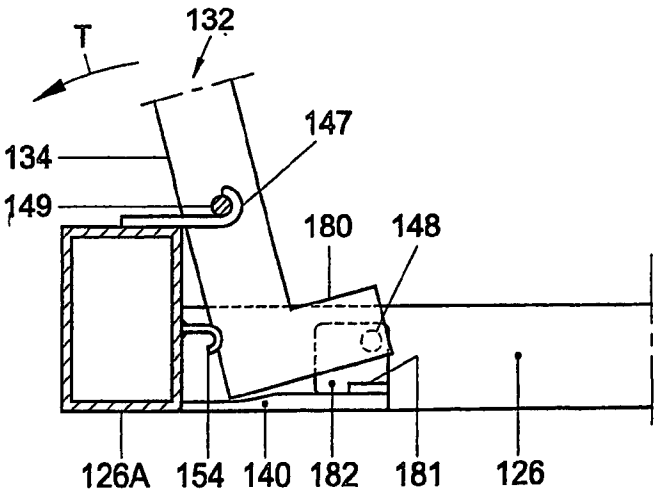
FIGS. 10A–D show in four steps the folding of a frame with sack-shaped element according to FIGS. 8 and 9.
Figure 10D:
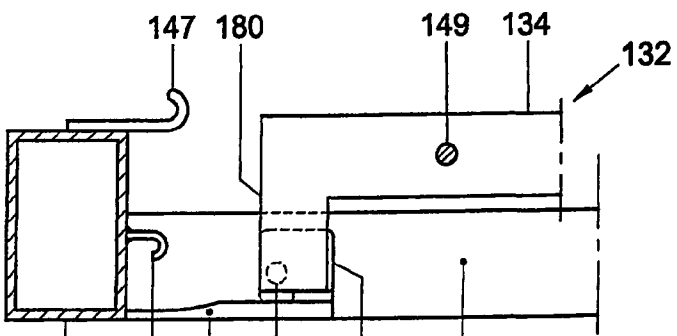
Figure 10A:
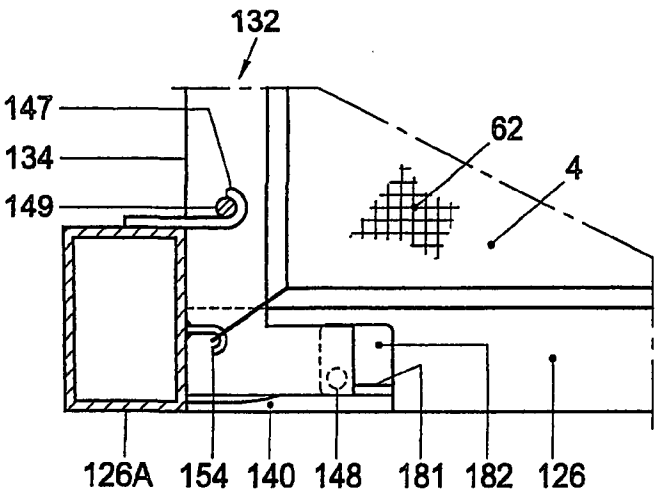
Figure 10C:
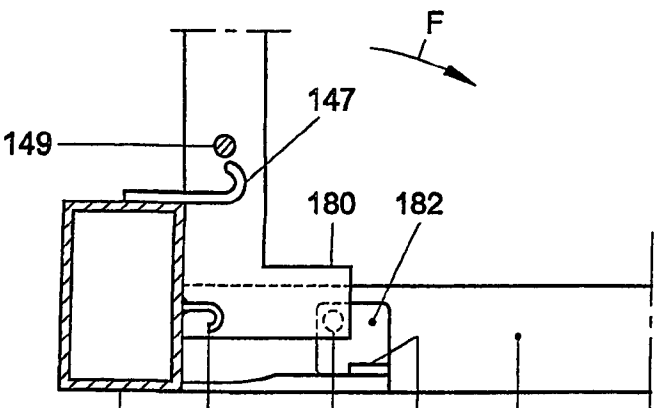

From the set-up position, as shown in FIG. 10A, where a lower corner of the frame 102 is shown, the sack-shaped element 4 is detached from the hooks 154, 156, after it has been emptied. Then, the frame wall part 132 is lifted up somewhat, until the leg part 180 reaches above the locking projection 181, whereupon it is tilted outwards in the direction T, remote to the arrow F in FIG. 8, about the cross bar 149 within the hook-shaped elements 147, such that the blocking pen 148 is pushed in the upper corner of the recess 182 remote from the cross beam 126A. When moving the frame wall part 132 upwards, the hook-shaped elements 147 and/or the cross bar 149 are somewhat deformed, so as to enable the desired movement. Due to the position of the blocking pen 148, further rotation is prevented. This position is shown in FIG. 10B. From this position, the frame wall part 132 is pulled upwards, approximately parallel to the plane of the frame wall part 132, such that the cross bar 149 is pulled from the hook-shaped elements 147. Here, preferably, a slight elastic deformation should occur, so that a good confinement can be obtained. In FIG. 10C, the cross bar 149 is shown detached from the hook-shaped elements 147, the frame wall part being moved somewhat up relative to the position as shown in FIG. 10A, such that the blocking pin 148 is pushed into the upper corner of the recess 182, proximal to the cross beam 126A. Then, the frame wall part 132 is tilted in the direction F, to the position shown in FIG. 10D, wherein the legs 134 extend parallel to the longitudinal girders 126, while the leg part 180 extends approximately vertically and rests on the plate 140. Here, the blocking pin 148 lies at the bottom of the recess 182.

It will be directly clear that a frame wall part 132 can be simply brought from the position shown in FIG. 10D to the position shown in FIG. 10A, in an order reverse to the earlier described order for folding. Further, it will be clear that a packaging device 101 according to FIGS. 8–10 can be used in the same or a comparable manner as the earlier described embodiments. With the embodiments shown, the sack-shaped element can, for instance, be designed as a big bag. A packaging device according to the invention preferably has a modular size fitting to standard (shipping) containers, for instance (x*0.5)m×(y* 0.6)m×(z×0.6 m), wherein x, y and z are integrals.

The invention is not in any way limited to the embodiments presented in the description and shown in the drawings. Many variations thereon are possible within the framework of the invention as outlined by the claims.

For instance, the frames can be designed in very many other manners, for instance such that it can be wholly or partly detached instead of being folded. Also, other types of sack-shaped elements can be used. Further, for instance, more than two frame wall parts can be provided, so that various sack-shaped elements can be suspended in de packaging device according to the invention while the frame wall parts can also be built up differently, for instance from wire netting, plate material or the like. Further, a packaging device according to the invention can be used for all sorts of products. Also, the sack-shaped elements and/or the frames can be transported in different manners, combined or separate from each other. Naturally, the sack-shaped elements themselves can be emptied in a warehouse in a manner known per se. However, storage in the packaging devices is preferred in view of the advantageous ventilation and the manageability.

These and many comparable variations are understood to fall within the scope of the invention as outlined by the claims.

What is claimed is:

1. A packaging device for cocoa beans or like bean-shaped natural products, which packaging device comprises a frame and a sack-shaped element suspendible therein, which sack-shaped element is ventilating, wherein a filling opening is provided for at least bringing said products into the sack-shaped element and wherein the frame with the filled sack is stackable, wherein the sack-shaped element is removably suspended within said frame and is substantially manufactured from textile woven plastic and/or ventilating film, wherein the frame is substantially foldable or detachable, wherein, in operative condition, the sack-shaped element at least comprises an upstanding wall closed in itself including a pair of opposing wall parts each having a height and a bottom connected thereto, wherein the opposing wall parts are connected to each other by at least one dividing wall, wherein the at least one dividing wall has an edge running the length of the at least one dividing wall spaced from the bottom and has a height smaller than the height of each of the opposing wall parts, the arrangement being such that adjacent said at least one dividing wall an opening is formed between the bottom and the edge of the at least one dividing wall proximal to the bottom.

2. A packaging device according to claim 1, wherein the frame comprises a bottom frame and two frame wall parts, wherein the frame wall parts extend at two opposite ends of the bottom frame and are pivotally connected therewith via hinging means, such that the frame wall parts can be brought into a first position wherein they extend approximately parallel to the bottom frame and into a second position wherein they extend approximately at right angles to the bottom frame.

3. A packaging device according to claim 2, wherein the frame wall parts include legs and the bottom frame is provided with recesses in which legs of the respective frame wall parts are receivable, wherein the legs and the recesses are provided with cooperating blocking means, designed such that the frame wall parts should be lifted up somewhat before they can be pivoted from the second position to the first position such that, with a set-up frame, the frame wall parts are held in the first position at least under the influence of gravity.

4. A packaging device according to claim 3, wherein in or adjacent the recesses or the legs, spring means are provided, such that the frame wall parts should be pivoted somewhat in a direction remote from each other against the spring action, before they can be lifted from the second position and be brought to the first position.

5. A packaging device according to claim 3, wherein the blocking means in the recess comprise a guideway and the legs are provided with a guiding pin cooperating therewith, such that in the second position the guiding pin is received in a part of the guideway whence it cannot be moved approximately parallel to the plane defined by the respective frame wall part.

6. A packaging device according to claim 1, wherein, in operative condition, the sack-shaped element is somewhat stretched within the frame, and the sack-shaped element being detachably connected to the frame both at the upper side and at the lower side of the sack-shaped element.

7. A packaging device according to claim 1, wherein the sack-shaped element is provided in a wall part with an opening for taking samples of the products therein.

8. A packaging device according to claim 1, wherein the sack-shaped element is washable.

9. A packaging device according to claim 1, wherein the frame is provided with first stacking means adjacent the upper side and with second stacking means adjacent the lower side, such that frames can be stacked by cooperation of first and second stacking means, wherein the frames can be stacked both one straight over the other and in interlocking patterns.

10. A packaging device according to claim 1, wherein the outer dimensions of the packaging device in set-up condition are substantially defined by the dimensions of the frame, which outer dimensions are chosen such that a stacked series of packaging devices is fittingly receivable within a shipping container.

11. A packaging device according to claim 10, wherein, in set-up condition, the frame has outer dimensions with a modular size of approximately 0.5 meter×0.6 meter×0.6 meter.

12. An assembly of a container and a series of packaging devices according to claim 1, wherein the packaging devices are fittingly stacked in the container.

13. A sack-shaped element as inner package for forming a packaging device according to claim 1.

14. A storage space and processing apparatus for cocoa beans and like bean-shaped natural products wherein packaging devices according to claim 1 are used for storing the cocoa beans or like bean-shaped natural products, wherein lifting means are provided for stacking and destacking the packaging devices, wherein, further, means are provided for tilting the packaging devices over at least 90°, for emptying them into the processing apparatus.

15. A storage space and processing apparatus according to claim 14, wherein said tilting means tilt the packaging devices over approximately 180°.

16. A storage space and processing apparatus according to claim 14, wherein racks with rolling means are provided in which the packaging devices can be arranged such that the packaging devices can be moved over the rolling means within the racks so that, each time, one of said packaging devices can be placed or taken out with the lifting means.

17. A packaging device for cocoa beans or like bean-shaped natural products, which packaging device comprises a frame and a sack-shaped element suspendible therein, which sack-shaped element is ventilating, wherein a filling opening is provided for at least bringing said products into the sack-shaped element and wherein the frame with the filled sack is stackable, wherein the sack-shaped element is removably suspended within said frame and is substantially manufactured from textile woven plastic and/or ventilating film, wherein the frame is substantially foldable or detachable and comprises a bottom frame and two frame wall parts, wherein the frame wall parts each include legs and extend at two opposite ends of the bottom frame and are pivotally connected therewith via hinging means, such that the frame wall parts can be brought into a first position wherein they extend approximately parallel to the bottom frame and into a second position wherein they extend approximately at right angles to the bottom frame and wherein the bottom frame is provided with recesses in which said legs of the respective frame wall parts are receivable, wherein the legs and the recesses are provided with cooperating blocking means, designed such that the frame wall parts should be lifted up somewhat before they can be pivoted from the second position to the first position such that, with a set-up frame, the frame wall parts are held in the first position at least under the influence of gravity and wherein in or adjacent the recesses or the legs, spring means are provided, such that the frame wall parts should be pivoted somewhat in a direction remote from each other against the spring action, before they can be lifted from the second position and be brought to the first position.

18. A storage space and processing apparatus for cocoa beans and like bean-shaped natural products comprising:

packaging devices each comprising:

a frame; and a sack-shaped element suspendible within said frame, which sack-shaped element is ventilating, wherein a filling opening is provided for at least bringing said products into the sack-shaped element and wherein the frame with the filled sack is stackable, wherein the sack-shaped element is removably suspended within said frame and is substantially manufactured from textile woven plastic and/or ventilating film, wherein the frame is substantially foldable or detachable; and wherein said storage space and processing apparatus is used for storing the cocoa beans or like bean-shaped natural products, wherein lifting means are provided for stacking and destacking the packaging devices, wherein, further, means are provided for tilting the packaging devices over at least more than 90° for emptying them into the processing apparatus and wherein racks with rolling means are provided in which the packaging devices can be arranged such that the packaging devices can be moved over the rolling means within the racks so that, each time, one of said packaging devices can be placed or taken out with the lifting means.

* * * * *